US006530132B2

(12) United States Patent
Yamagishi et al.

(10) Patent No.: US 6,530,132 B2
(45) Date of Patent: Mar. 11, 2003

(54) SLIDER FOR LINEAR SLIDE FASTENER

(75) Inventors: Koji Yamagishi, Toyama-ken (JP); Morimasa Yoneoka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/964,620

(22) Filed: Sep. 28, 2001

(65) Prior Publication Data

US 2002/0038496 A1 Apr. 4, 2002

(30) Foreign Application Priority Data

Sep. 29, 2000 (JP) ..... 2000-299999

(51) Int. Cl.[7] ..... A44B 19/26
(52) U.S. Cl. ..... 24/427; 24/415; 24/428
(58) Field of Search ..... 24/415, 418, 428, 24/427

(56) References Cited

U.S. PATENT DOCUMENTS 3,872,553 A * 3/1975 Moertel ..... 24/428
4,055,876 A * 11/1977 Ackermann et al. ..... 24/421
4,409,705 A * 10/1983 Yuunaga ..... 24/415
4,562,622 A * 1/1986 Takabatake ..... 24/427
5,898,979 A * 5/1999 Hamada ..... 24/415

FOREIGN PATENT DOCUMENTS

JP 2000-262309 A * 9/2000 ..... A44B/19/26

* cited by examiner

*Primary Examiner*—Robert J. Sandy
(74) *Attorney, Agent, or Firm*—Finnegan, Henrderson, Farabow, Garrett, & Dunner, L.L.P.

(57) ABSTRACT

A slider, which can be closed easily without a separation of a chain even if a lateral pulling load is applied to the fastener chain when the linear fastener chain is closed with the slider. An element pressing face, which is in contact with an inverted portion of a linear slide fastener element and putting it thereon, is provided along an inner side face of a flange formed on each of both right and left sides of an upper wing plate or a lower wing plate of the slider. A slope is formed on the pressing face from a front end thereof up to a vicinity of a bent portion of the flange such that it intersects an inner face of the upper or lower wing plates. A vertical wall is provided from the bent portion to a rear mouth so as to be erected from the upper or lower wing plates. The pressing face is formed on the vertical wall so that the inverted portion can be guided. Consequently, even if the lateral pulling load is applied to the fastener chain when the fastener chain is closed, the inverted portion is slid on the slope and introduced to a proper state, thereby making it possible to prevent a separation of the chain.

5 Claims, 7 Drawing Sheets

<PRIOR ART>

SLIDER FOR LINEAR SLIDE FASTENER

BACKGROUND OF THE INVENTION

1. Field of the Invention

The present invention relates to a slider for linear slide fastener, and more particularly to a slider for linear slide fastener suitable for a fastener chain, in which a flange of the slider is improved and a linear fastener element formed of monofilament of thermoplastic resin in a coil shape or zigzag shape is mounted on a side edge of a fastener tape.

2. Description of the Related Art

In a conventional slider for linear slide fastener of this kind, an inverted portion of a fastener element is placed on an inside corner throughout an entire length of a guide flange provided on each of both right and left sides of an upper wing plate of a slider, while a step-like element pressing face capable of guiding the fastener element is provided at the flange.

Further, in a slider for linear slide fastener disclosed in Japanese Utility Model Application Laid-Open No. 57-7313, as shown in FIG. 11, an element pressing portion 14', whose lateral cross section is protruded in the form of a step, is provided along the inside corner in the longitudinal direction of a guide flange 12' provided on each of both right and left sides of an upper wing plate 2' and a chamfered portion 31' is provided on an end portion of a front end of each element pressing portion 14' such that it is elevated gradually from the front end to a rear mouth 17' and inclines so as to continue to a face forming the element pressing portion 14'.

In the slider provided with the step-like element pressing portion throughout the entire length of the guide flange of the slider described previously, if a lateral pulling load is applied to the fastener chain when the fastener chain is closed, the inverted portion of the linear fastener element slips out of the element pressing portion, so that right and left fastener elements do not engage with each other properly, thereby causing a separation of the chain.

Further, in the slider shown in FIG. 11, the element pressing portion 14', whose lateral cross section is protruded in the form of a step, is provided along the inside corner in the longitudinal direction of the flange 12', which is provided on each of both right and left sides of the upper wing plate 2', for guiding a coil-like fastener element 21' and the chamfered portion 31' is provided on an end portion of a front end of each element pressing portion 14' such that it is elevated gradually from the front end to the rear mouth 17' and inclines so as to continue to the face forming the element pressing portion 14'. The lateral cross section of the element pressing portion 14' is step-like through the entire length from the front end of the flange 12' to the rear mouth 17', that is, a vertical wall 13' is formed on an end edge of each element pressing portion 14'. If a lateral pulling load is applied to the fastener chain when the fastener chain is closed under this structure, the inverted portion 25' of the coil-like fastener element 21' slips out of the element pressing portion 14' so that it drops between the vertical walls 13'. As a result, the fastener chain is deformed into a V shape, so that the right and left fastener elements 21' do not engage with each other properly, thereby causing a separation of the chain. Consequently, there is a problem that the sliding operation of the slider becomes heavy, thereby preventing the slider from being operated smoothly.

SUMMARY OF THE INVENTION

The present invention has been achieved in views of the above-described problems. An object of the invention is to provide a slider for linear slide fastener, wherein even if a lateral pulling load is applied to a fastener chain when the fastener chain is closed with the slider, inverted portions of right and left fastener elements are allowed to slide on slopes easily and introduced to a proper state before coupling heads of the fastener elements engage with each other, so that the coupling heads of the right and left fastener elements engage with each other accurately, thereby enabling the slider to be closed smoothly without inducing a separation of the chain.

It is another object of the invention to provide a slider for linear slide fastener comprising an element pressing face which induces no separation of the chain easily even if the lateral pulling load is applied to the fastener chain when the fastener chain of the linear slide fastener is closed with the slider, thereby enabling a smooth closing operation.

It is also another object of the invention is to provide a slider for slide fastener comprising a concrete mechanism which induces no separation of the chain easily even if the lateral pulling load is applied to the fastener chain when the fastener chain of the linear slide fastener is closed with the slider, thereby enabling a smooth closing operation.

Further, an object of the invention is to provide a slider for linear slide fastener suitable for a fastener chain, wherein the linear fastener element of the linear slide fastener formed of coil-like fastener element of thermoplastic resin is attached on a side edge of the fastener tape.

Still further, an object of the invention is to provide a slider for linear slide fastener suitable for a fastener chain, wherein the linear fastener element of the linear slide fastener formed of zigzag-like fastener element of thermoplastic resin is attached on a side edge of the fastener tape.

To achieve the above object, according to the invention, there is provided a slider for linear slide fastener, wherein an element pressing face, which is in contact with an inverted portion of a linear slide fastener element and capable of putting the inverted portion thereon, is provided along an inner side face in a longitudinal direction of a guide flange formed on each of both right and left sides of an upper wing plate or a lower wing plate of a body, a slope is formed on the pressing face from a front end of the flange up to a vicinity of a bent portion of the flange such that it intersects an inner face of the upper wing plate or lower wing plate, a vertical wall is provided from the vicinity of the bent portion to a rear mouth of the flange so as to be erected from the upper wing plate or the lower wing plate and the pressing face is formed on the vertical wall so as to guide the inverted portion of the linear slide fastener element.

Preferably, the slope provided on the inner side face of the flange formed on the upper wing plate or the lower wing plate of the body is formed wide on the side of the front end of the flange, while the slope is formed such that a width thereof decreases gradually toward the bent portion so that it is connected with the pressing face provided on the vertical wall in the vicinity of the bent portion.

Also preferably, a coupling head pressing face is formed in the center of the upper wing plate or the lower wing plate, in which the flange is provided, so as to extend from a diamond to the rear mouth of the slider body, the vertical walls provided on the right and left flanges are disposed in parallel to and opposing each other such that a guide groove is formed between the vertical wall and the element pressing face and the slopes provided on the flanges are formed so as to oppose each other in a range from the diamond up to a coupling intersecting point of the linear fastener element.

Further preferably, the linear fastener element is formed of coil-like fastener element of thermoplastic resin monofilament and the coil-like fastener element is mounted on a side edge of a fastener tape with an attaching yarn.

And further, the linear fastener element is formed of zigzag-like fastener element of thermoplastic resin monofilament and the zigzag-like fastener element is mounted on a side edge of a fastener tape with an attaching yarn.

DESCRIPTION OF THE PREFERRED EMBODIMENTS

Figure 1:
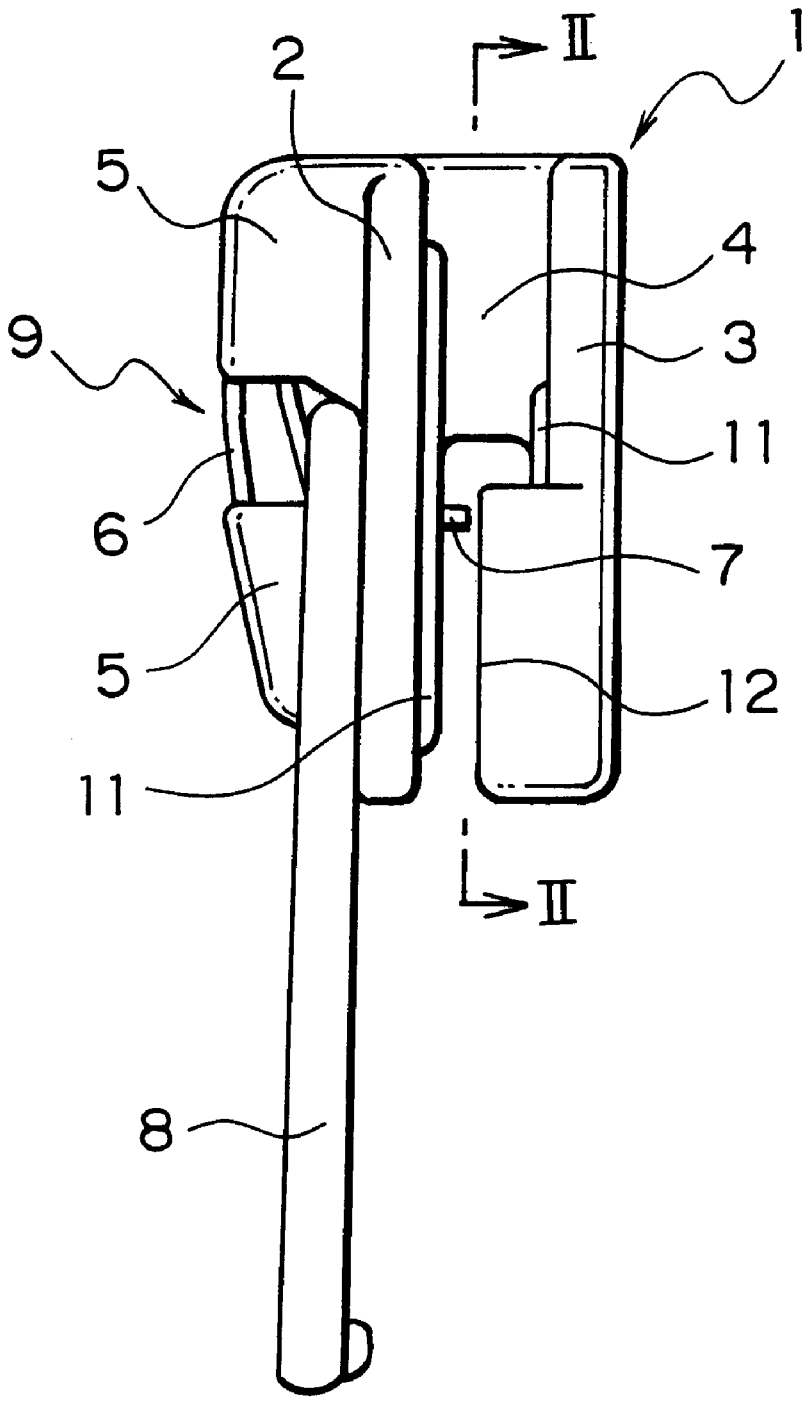
FIG. 1 is a side view of a slider for linear slide fastener of a first embodiment of the invention.
Figure 2:
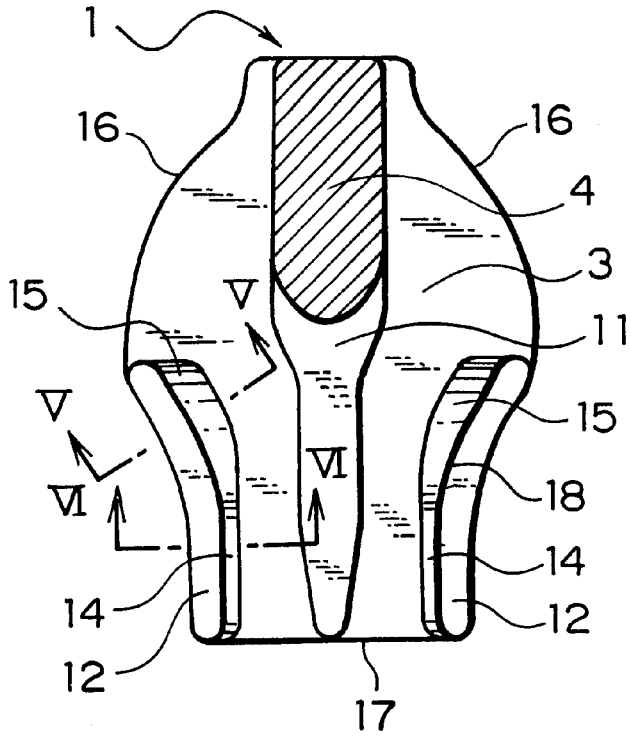
FIG. 2 is a sectional view of the same slider taken along the line II—II in FIG. 1.
Figure 3:
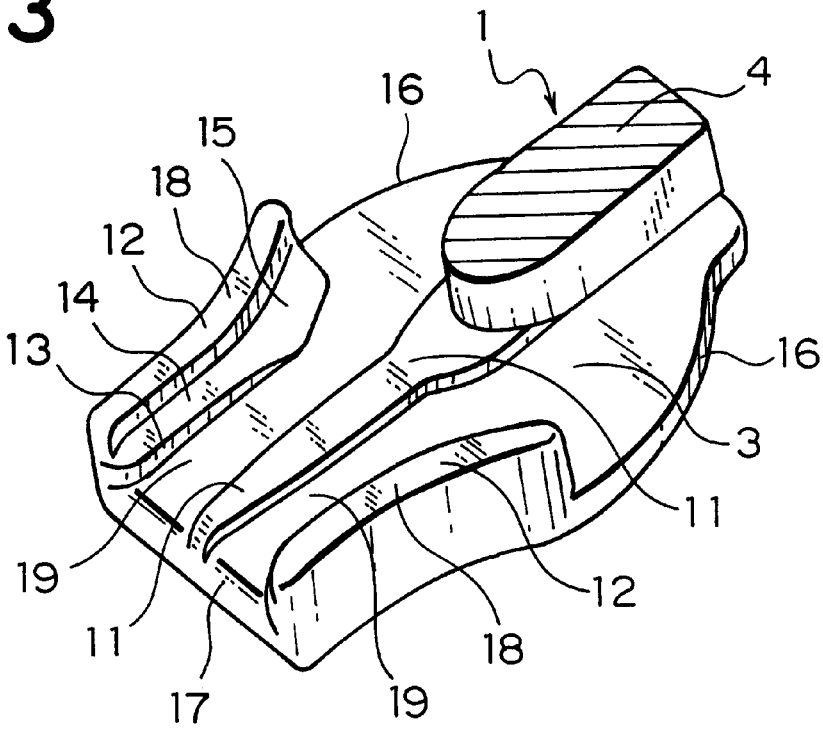
FIG. 3 is a perspective view of the slider of FIG. 2.

Hereinafter, the preferred embodiments of a slider for linear slide fastener of the invention will be described in detail with reference to the accompanying drawings.

In a slider for the linear slide fastener of a first embodiment of the invention, as shown in FIGS. 1 to 6, a body 1 of the slider is comprised of an upper wing plate 2 and a lower wing plate 3, which are connected each other via a diamond 4. Attaching posts 5 having a gap for attaching a spring 6 of an automatic stop mechanism 9 are provided on front and rear portions of an upper surface of the upper wing plate 2. The U-shaped spring 6 having a locking pawl 7, which is provided on an end of the spring 6 such that it is bent, is incorporated and fixed between the attaching posts 5. The locking pawl 7 is protruded into the body 1 through a pawl hole 10 made in a coupling head pressing face 11 formed in the center of an inner face of the upper wing plate 2. A pintle of a pull 8 is interposed between the front and rear attaching posts 5 such that it is held between the spring 6 and the body 1 so as to complete the automatic stop mechanism 9. Then, by operating the pull 8, the locking pawl 7 may appear into the body 1.

The lower wing plate 3 of the body 1 has a guide flange 12 for guiding a linear fastener element 20 provided on each of both right and left sides thereof. A pressing face 14 having a circular lateral sectional shape, for putting an inverted portion 25 of the linear fastener element 20 thereon and guiding it, is provided in a central portion of an inner face of this flange 12. A vertical wall 13 is provided on end edges of the pressing face 14 such that it is perpendicular to the lower wing plate 3.

In a range from a front end on the side of a shoulder mouth 16 up to the vicinity of a bent portion 18 of the flange 12, namely a range from the diamond 4 up to a coupling intersecting point P in which coupling heads 23 of the right and left linear fastener elements 20 are coupled each other, the vertical wall 13 is not provided while instead, slopes 15, which are inclined including the pressing faces 14 and the lower wing plate 3, are formed. The slopes 15 are formed in such a form that allows the inverted portion 25 of the linear fastener element 20 to slide. Then, the slope 15 is continued to and absorbed by the pressing face 14 having the vertical wall 13 in the vicinity of the bent portion 18, so that the inverted portion 25 of the linear fastener element 20 is guided smoothly to the pressing face 14.

A coupling head pressing face 11 for guiding the coupling head 23 of the linear fastener element 20 is formed in the center of an inner face of the lower wing plate 3 such that it is swollen from the diamond 4 up to a rear mouth 17. Then, a guide groove 19 for guiding a sewing yarn sewn with double ring sewing method, that is, an attaching yarn 26, for attaching a leg portion 24 of the linear fastener element 20 onto a fastener tape 27 is provided so as to be concaved between this coupling head pressing face 11 and the vertical wall 13.

The body 1 of the slider is produced by die-casting such metal as zinc alloy, aluminum alloy and the like. A free slider having no automatic stop mechanism 9 may be formed by injection molding using thermoplastic resin such as polyacetal, polyamide, polypropylene and polypropylene terephthalate or adding abrasion resistant reinforcing material to these resins.

Figure 4:
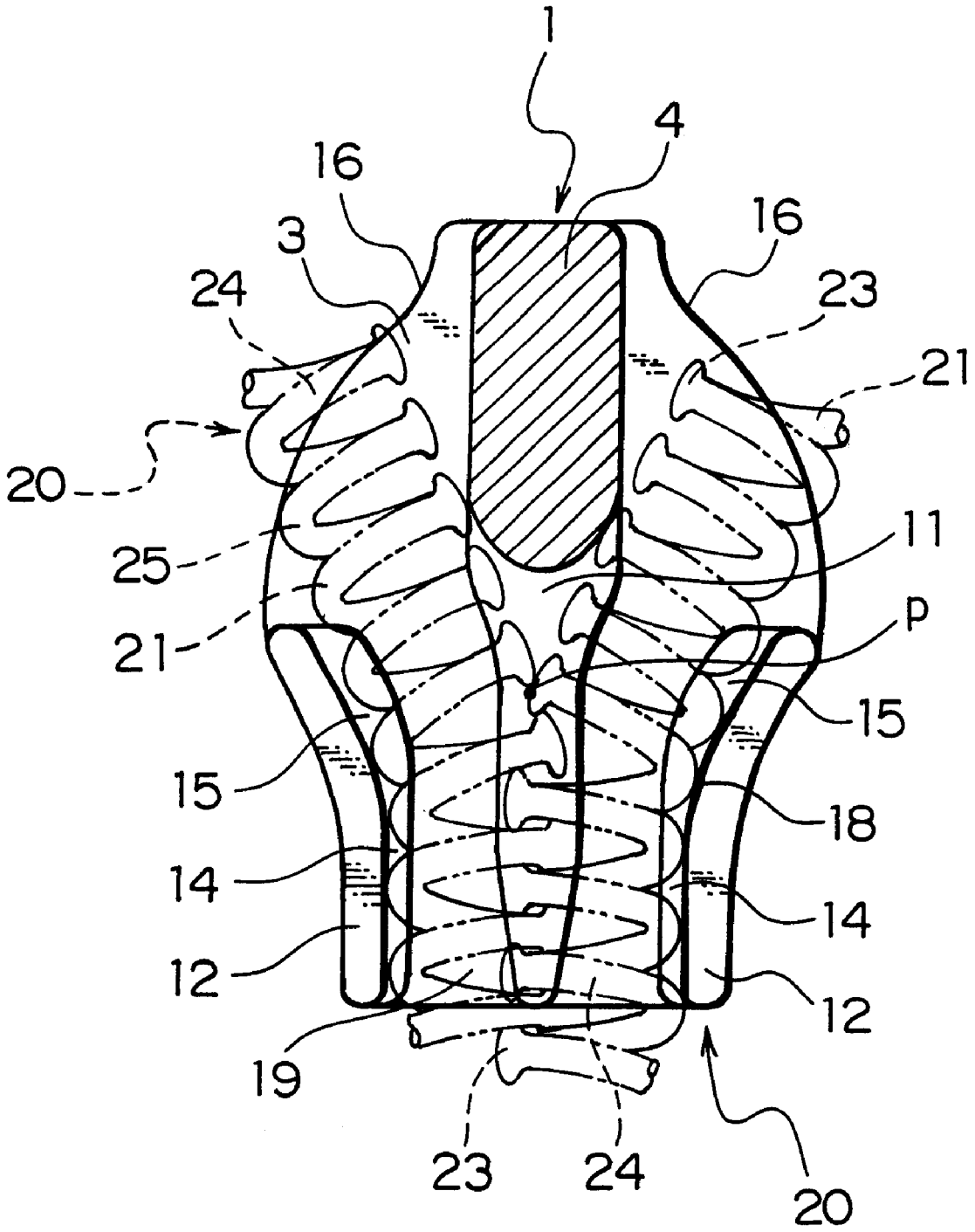
FIG. 4 is a sectional view showing a state in which a coil-shaped fastener element is inserted into the slider of FIG. 2.
Figure 5:
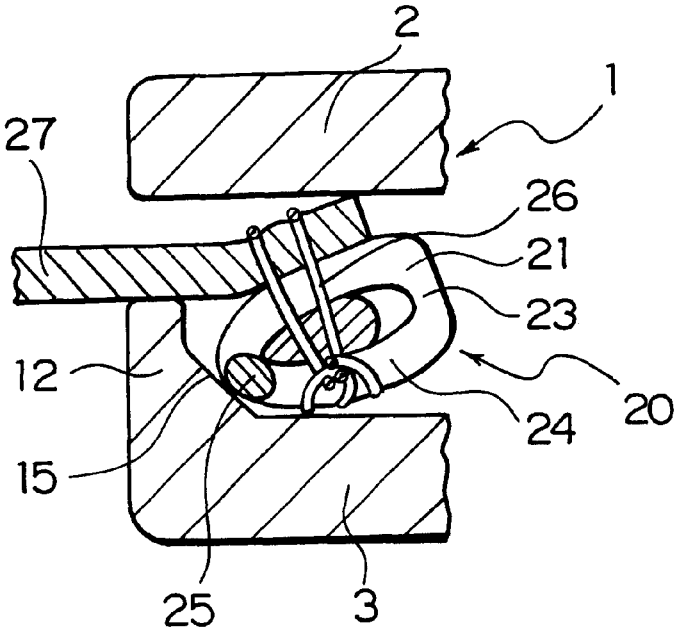
FIG. 5 is a sectional view of the slider taken along the line V—V in FIG. 2 with the fastener chain inserted through the slider.
Figure 6:
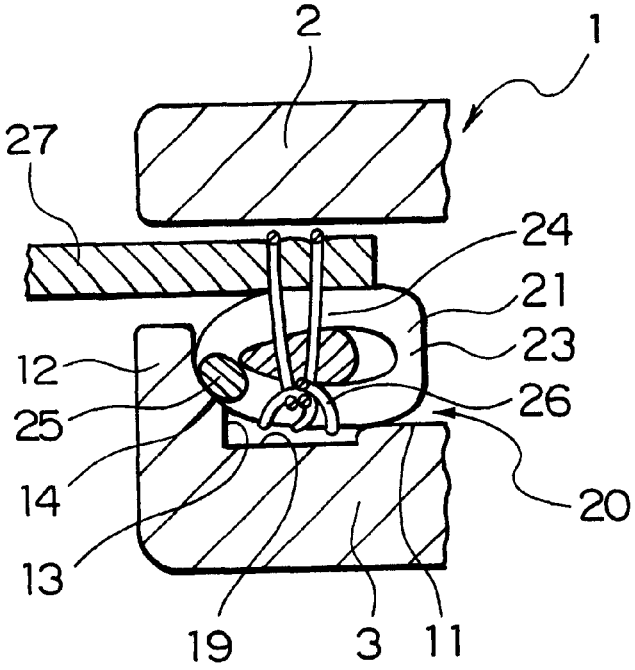
FIG. 6 is a sectional view of the slider taken along the line VI—VI in FIG. 2 with the fastener chain inserted through the slider.

In the slider described above, if a coil-like fastener element 21 is inserted through the body 1 of the slider as shown in FIG. 4 and the slider is slid in a direction of closing the fastener chain, the inverted portion 25 of the coil-like fastener element 21 is introduced to the slope 15 of the guide flange 12 successively as shown in FIG. 5, so that the inverted portion 25 is placed and guided onto the pressing face 14 of the flange 12 at the coupling intersecting point P of the coupling head 23 as shown in FIG. 6.

Therefore, if as shown in FIG. 4, a lateral pulling force is applied to the coil-like fastener element 21 between a front end of the flange 21 and the coupling intersecting point P, the coupling head 23 of the coil-like fastener element 21 is floated by the lateral pulling force of the fastener tape 27 as shown in FIG. 5, so that the coil-like fastener element 21 is raised. However, the inverted portion 25 of the coil-like fastener element 21 is slid gradually upward along the slope 15 and after the coil-like fastener element 21 passing the coupling intersecting point P, it is introduced to a predetermined position as shown in FIG. 6 so that a proper engagement is achieved. Consequently, separation of the chain is not induced in the fastener chain, thereby making it possible to open/close the fastener chain smoothly.

Figure 7:
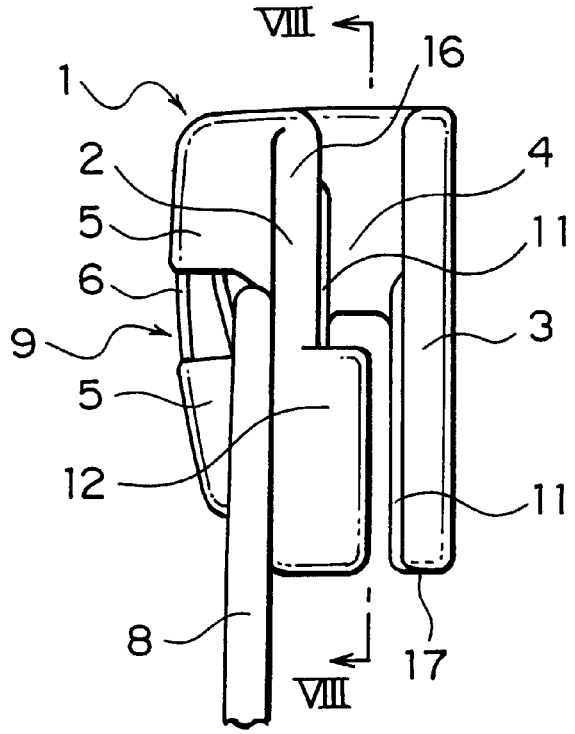
FIG. 7 is a side view of a slider for the linear slide fastener of a second embodiment of the invention.
Figure 8:
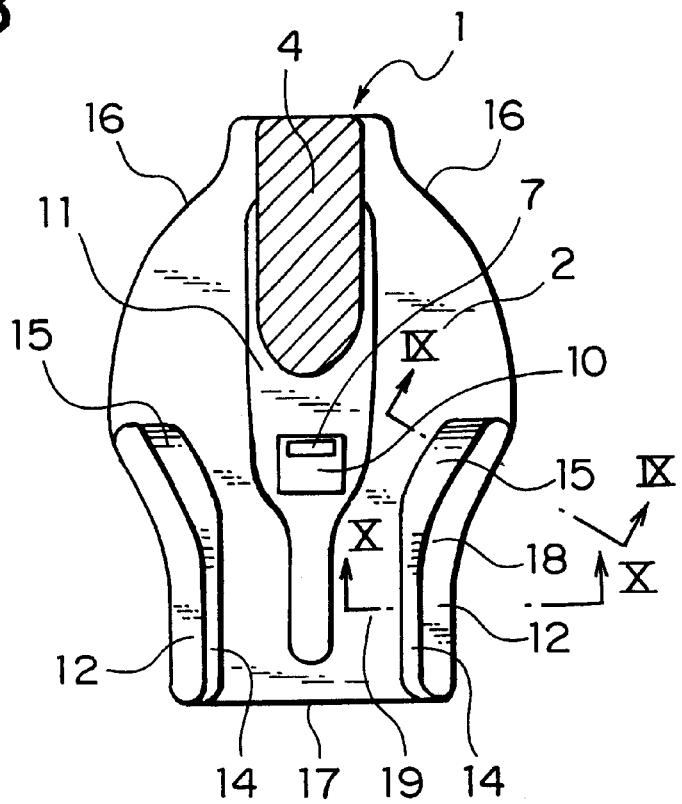
FIG. 8 is a sectional view of the slider taken along the line VIII—VIII in FIG. 7.

In a slider according to a second embodiment of the invention, as shown in FIGS. 7 and 8, the flange 12 for guiding the linear fastener element 20 is provided on both right and left sides of the upper wing plate 2 of the body 1 and the attaching post 5 is erected on a upper surface of the upper wing plate 2 and the automatic stop mechanism 9 is provided there like the above-described embodiment. As to a rear surface of the upper wing plate 2, as shown in FIG. 8, the coupling head pressing face 11 for guiding the coupling head 23 of the linear fastener element 20 is formed in the center of the longitudinal direction of the upper wing plate 2 such that it is extended from the diamond 4 to the rear mouth 17 and then, the flanges 12 for guiding the inverted portions 25 of the linear fastener element 20 are provided on both right and left sides of the upper wing plate 2.

The pressing face 14 having a circular lateral cross section is provided in the center of an inner face of the flange 12 for guiding the inverted portion 25 of the linear fastener element 20. The vertical wall 13, which is vertical to the upper wing plate 2, is provided on an end edge of this pressing face 14, while the vertical wall 13 is not formed in a range from a front end of the shoulder mouth 16 of the flange 12 up to the bent portion 18, that is, in a range from the diamond 4 to the coupling intersecting point P in which the coupling heads 23 of the right and left linear fastener elements 20 engage with each other and instead, the slope 15 is formed so as to be faced each other such that the slope 15 is inclined including the pressing face 14 as well as the upper wing plate.

The slopes 15 are formed so as to enable the inverted portions 25 of the linear fastener elements 20 to slide. The slopes 15 is connected to the pressing face 14 having the vertical wall 13 in the vicinity of the bent portions 18 and guide the inverted portions 25 of the linear fastener elements 20 to the pressing face 14 smoothly. Further, the coupling head pressing face 11 is provided in the center of an inner face of the upper wing plate 2 such that it is swollen from the diamond 4 to the rear mouth 17. A pawl hole 10 is made in the center of this coupling head pressing face 11 so that the locking pawl 7 of the automatic stop mechanism 9 is capable of appearing there. Then, the guide grooves 19 for guiding the attaching yarns 26, which attach the leg portions 24 of the linear fastener elements 20, are provided on the right and left between the coupling head pressing face 11 and the vertical wall 13 such that they are concaved. Meanwhile, condition for the use of this slider is completely the same as the above-mentioned slider.

As the linear fastener element 20, it is permissible to use the zigzag-like fastener element 22 instead of the coil-like fastener element 21. By inserting the zigzag-like fastener element 22 as the linear fastener element 20 through the body 1 of the slider of the second embodiment as shown in FIGS. 9 and 10, for example, the fastener chain is completed.

Figure 9:
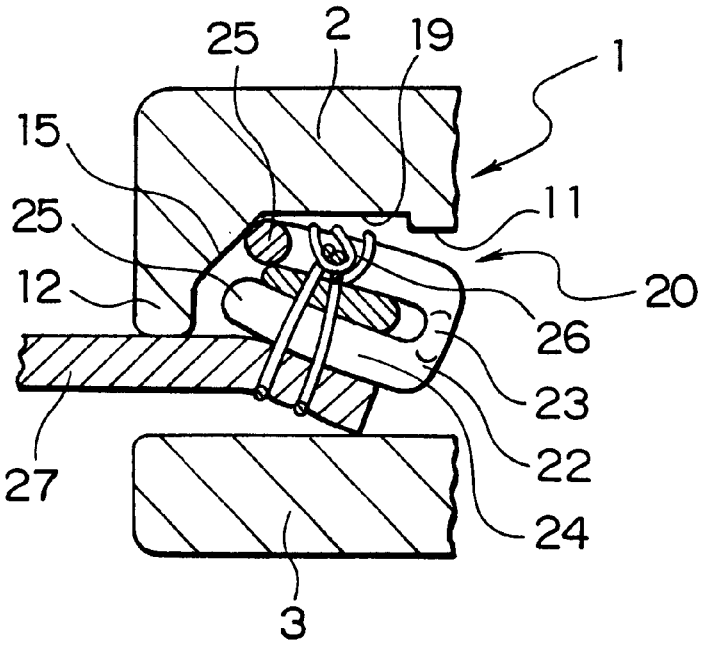
FIG. 9 is a sectional view of the slider taken along the line IX—IX in FIG. 8 with the zigzag-shaped fastener chain inserted through the slider.
Figure 10:
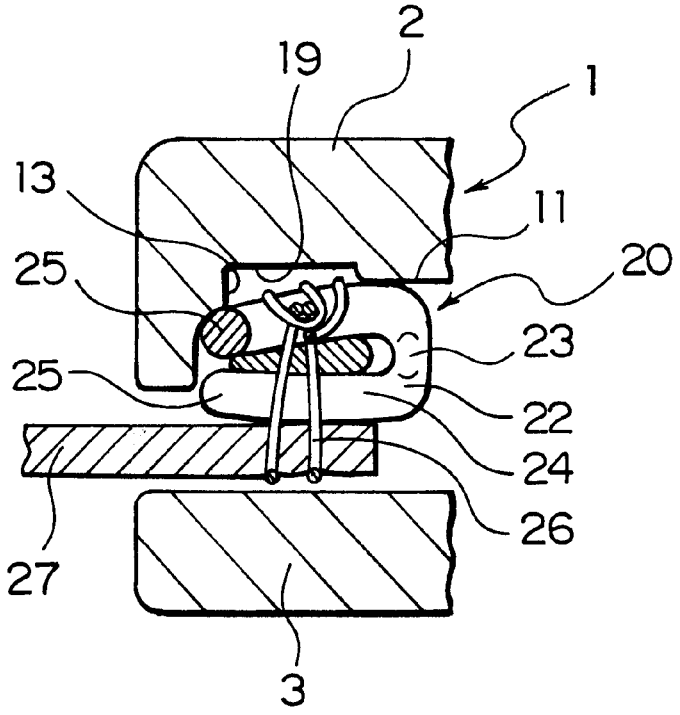
FIG. 10 is a sectional view of the slider taken along the line X—X in FIG. 8.
Figure 11:
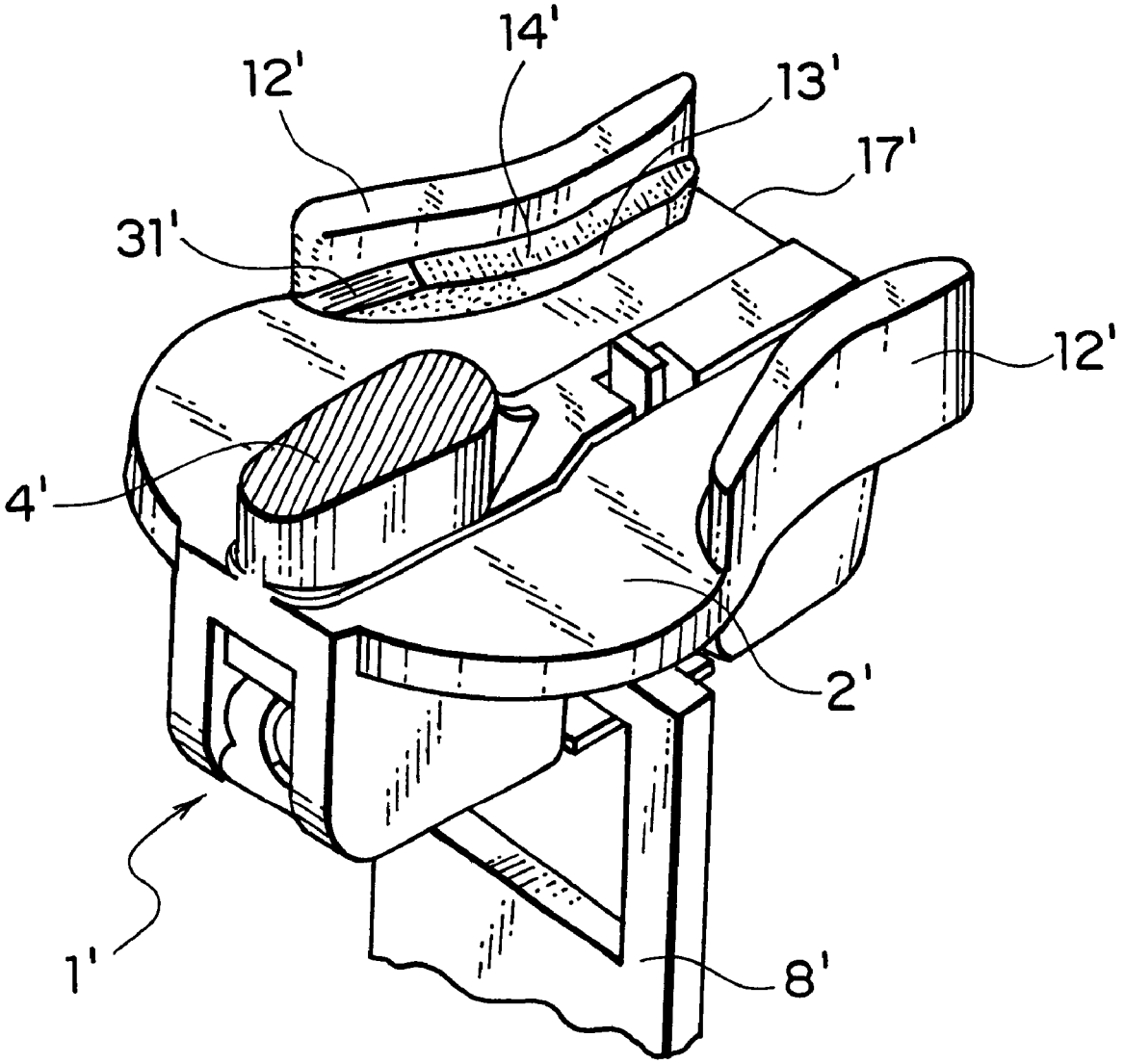
FIG. 11 is a perspective view of major portions of a well-known slider.

In this slider also, if the lateral pulling load is applied to the fastener chain inserted through the body 1 of the slider, the coupling head 23 of the zigzag-like fastener element 22 is raised as shown in FIG. 9 and if the slider slides in the closing direction with this condition, the inverted portion 25 slides on the slope 15 from the front end of the flange 12 to the bent portion 18, so that the inverted portion 25 is introduced to the pressing face 14 provided with the vertical wall 13, for example, to a state shown in FIG. 10, in the vicinity of the bent portion 18. As a result, no separation of the chain is induced in this fastener chain, so that a proper zigzag-like fastener chain, in which the right and left coupling heads 23 engage with each other, is obtained.

The slider for linear slide fastener of the invention has the above-described structure and following effects are achieved with such a structure.

According to the invention, there is provided a slider for linear slide fastener, wherein an element pressing face 14, which is in contact with an inverted portion 25 of a linear slide fastener element 20, is provided along an inner side face in the longitudinal direction of a guide flange 12 formed on each of both right and left sides of an upper wing plate 2 or a lower wing plate 3 of a body 1, a slope 15 is formed on the pressing face 14 from a front end thereof up to the vicinity of a bent portion 18 of the flange 12 such that it intersects an inner face of the wing plate 2 or 3 and the pressing face 14 is formed on a vertical wall 13 from the vicinity of the bent portion 18 to a rear mouth 17 so as to guide the inverted portion 25. Consequently, even if the lateral pulling load is applied to the fastener chain when the linear fastener chain is closed with the slider, the inverted portions 25 slide on the slopes 15 and are introduced to the predetermined pressing face 14 before the right and left fastener elements 20 engage with each other, so that the fastener elements are guided to a proper engagement condition thereby preventing a separation of the chain so as to ensure a smooth closing operation.

Further, the slope 15 provided on the inner side face of the flange 12 is formed wide on the side of the front end of the flange 12, while the slope 15 is formed such that a width thereof decreases gradually toward the bent portion 18 so that it is connected with the pressing face 14 on the vertical wall 13. Consequently, even if the lateral pulling load is applied to the fastener chain when the linear fastener is closed with the slider, a separation of the chain is not induced, so that the inverted portions 25 of the fastener elements 20 are introduced accurately thereby achieving a smooth closing operation.

And further, a coupling head pressing face 11 is formed in the center of the upper wing plate 2 or the lower wing plate 3 so as to extend from the diamond 4 to the rear mouth 17, the vertical walls 13 provided on the right and left flanges 12 are disposed in parallel to each other such that they oppose each other to form a guide groove 19 and the slopes 15 are formed so as to oppose each other in a range from the diamond 4 up to a coupling intersecting point P of the fastener element 20. Consequently, the attaching yarn 26 for attaching the fastener element 20 is protected easily and the separation of the chain is prevented securely by providing slopes 15 just in front of a position where the fastener elements 20 engage with each other.

Still further, the linear fastener element 20 is formed of coil-like fastener element 21 or zigzag-like fastener element 22 of thermoplastic resin and the fastener element 20 is mounted on a side edge of a fastener tape 27. Consequently, the separation of the chain can be prevented effectively by employing the coil-like fastener element 21 or the zigzag like fastener element 22 as the fastener element. Therefore, as described above, the effects, which the invention achieves, are very conspicuous.

What is claimed is:

1. A slider for linear slide fastener, wherein an element pressing face, which is in contact with an inverted portion of a linear slide fastener element, is provided along an inner side face in a longitudinal direction of a guide flange formed on each of both right and left sides of an upper wing plate or a lower wing plate of a body, and wherein each element pressing face comprises a slope formed from a front end of the pressing face up to a vicinity of a bent portion of the flange such that it intersects an inner face of the upper or lower wing plate, and a vertical wall and a guide face formed on the vertical wall for guiding the inverted portion of the fastener element, which are provided from the vicinity of the bent portion to a rear mouth.

2. A slider for linear slide fastener according to claim 1, wherein the slope provided on the inner side face of the flange is formed wide on the side of a front end of the flange, while said slope is formed such that a width thereof decreases gradually toward the bent portion so that it is connected with the pressing face formed on the vertical wall.

3. A slider for linear slide fastener according to claim 1, wherein a coupling head pressing face is formed in the center of the upper wing plate or the lower wing plate, such that it is provided from a diamond to the rear mouth, wherein the vertical walls provided on the right and left flanges are disposed in parallel to each other such that they oppose each other, wherein at least one guide groove is provided between the coupling head pressing face and at least one of the vertical walls, and wherein the slopes are formed so as to oppose each other in a range from the diamond up to a coupling intersecting point of the linear fastener element.

4. A slider for linear slide fastener according to claim 1, wherein the linear fastener element is formed of coil-like fastener element of thermoplastic resin and said fastener element is mounted on a side edge of a fastener tape.

5. A slider for linear slide fastener according to claim 1, wherein the linear fastener element is formed of zigzag-like fastener element of thermoplastic resin and said fastener element is mounted on a side edge of a fastener tape.

* * * * *